United States Patent [19]

Broom et al.

[11] Patent Number: 4,475,720

[45] Date of Patent: Oct. 9, 1984

[54] CASTHOUSE EMISSION CONTROL SYSTEM

[76] Inventors: Gilbert R. Broom, 11 Willow La., Schererville, Ind. 46375; Michael K. Buckley, 3703 175th Pl., Hammond, Ind. 46323

[21] Appl. No.: 474,888

[22] Filed: Mar. 14, 1983

[51] Int. Cl.[3] ..... F27D 3/14

[52] U.S. Cl. ..... 266/157; 266/196

[58] Field of Search ..... 266/157, 236, 196

[56] References Cited

U.S. PATENT DOCUMENTS 4,355,788 10/1982 LaBate ..... 266/157

*Primary Examiner*—M. J. Andrews

*Attorney, Agent, or Firm*—Woodard, Weikart, Emhardt & Naughton

[57] ABSTRACT

An emission control system for controlling the emissions released from the pig iron and slag released from a blast furnace and through the troughs in a casthouse. The system comprises tap hole cover means for covering the first end of the main iron trough and for evacuating emissions from the pig iron and slag flowing through the first end of the main iron trough. The tap hole cover means in flow communication with scrubber means for cleaning emissions. Removable cover means for covering the second end of the main iron trough and for evacuating emissions from the pig iron and slag flowing through the second end of the main iron trough. The removable cover means in flow communication with scrubber means for cleaning emissions. Main iron runner cover means for covering the main iron runner to prevent the escape of emissions into the ambient air. Slag runner cover means for covering the slag runner to prevent the escape of emissions into the ambient air. Iron runner emission evacuation means disposed at the iron exit end of the iron runner for evacuating emissions from the pig iron and slag flowing through the iron exit end. The iron runner emission evacuation means in flow communication with scrubber means for cleaning emissions.

8 Claims, 8 Drawing Figures

CASTHOUSE EMISSION CONTROL SYSTEM

BACKGROUND OF THE INVENTION

This invention relates to emission control systems and more particularly to an emission control system for a casthouse.

The Environmental Protection Agency has issued standards for the control of emissions from industrial plants. One of the plants that has been affected by these standards is the casthouse employed in the making of pig iron. A casthouse contains a blast furnace and a plurality of channels, runners and troughs through which the iron and slag that is tapped from the blast furnace is separated and delivered to iron and slag ladles. The iron in the iron ladles called pugh ladles is then taken to basic oxygen furnaces where it is converted to steel. The slag in the slag ladles is taken to the slag pits for land fill.

As the slag and pig iron mixture is tapped from the blast furnace there is a great amount of smoke containing silicon oxide, graphite, iron oxides, particulates, heat and other pollutants that is released into the ambient air from the mixture. This smoke continues to escape into the air from the slag and pig iron as they are channeled by the troughs into their respective ladles. Prior to the E.P.A. standards this smoke filled the casthouse and escaped into the atmosphere. However, this is now unacceptable and some systems exist for limiting and controlling the amounts of smoke and pollutants that are released into the ambient air.

One system basically covered all of the troughs and channels and thus turned them into tunnels. This prevented the smoke from exiting into the casthouse. However the emissions were not caught or treated. At the end of the tunnel whatever emissions had not cooled were released into the air. A further difficulty with the tunnel system is that it did not provide for the viewing of the pig iron and slag as it exited from the furnace. Being able to see the mixture as it came out of the furnace provides for a simple and efficient method to determine whether the cast is good.

Another system for controlling the emissions is using what is called a "bag" house. In this system arched covers are placed over all of the troughs. This entire network of tunnels is then evacuated by pipes connected to the covers. The system uses large fans of about 1000 horse power and roughly 250,000 cubic feet per minute capacity to evacuate all smoke from all of the tunnels. This is then transferred from the side of the arched covers and down into underfloor ducts where it is transferred to a "bag house". A bag house is a large structure containing "bags" through which the smoke is passed and cleaned.

SUMMARY OF THE INVENTION

An emission control system for controlling the emissions released from the pig iron and slag released from a blast furnace in a casthouse. The system comprises a blast furnace having a tap hole, a main iron trough having a first end and a second end. The first end of said main iron trough in flow communication with the tap hole. The main iron trough having skimmer means for separation of the pig iron and slag. A main iron runner having a first end and an iron exit end. The first end of the main iron runner in flow communication with the second end of the main iron trough. A slag runner having a first end and a slag exit end. The first end of the slag runner in flow communication with the second end of the main iron trough. Tap hole cover means for covering the first end of the main iron trough and for evacuating emissions from the pig iron and slag flowing through the first end of the main iron trough. The tap hole cover means in flow communication with scrubber means for cleaning emissions. Removable cover means for covering the second end of the main iron trough and for evacuating emissions from the pig iron and slag flowing through the second end of the main iron trough. The removable cover means in flow communication with scrubber means for cleaning emissions. Main iron runner cover means for covering the main iron runner to prevent the escape of emissions into the ambient air. Slag runner cover means for covering the slag runner to prevent the escape of emissions into the ambient air. Iron runner emission evacuation means disposed at the iron exit end of the iron runner for evacuating emissions from the pig iron and slag flowing through the iron exit end. The iron runner emission evacuation means in flow communication with scrubber means for cleaning emissions.

DESCRIPTION OF THE PREFERRED EMBODIMENT

Figure 1:
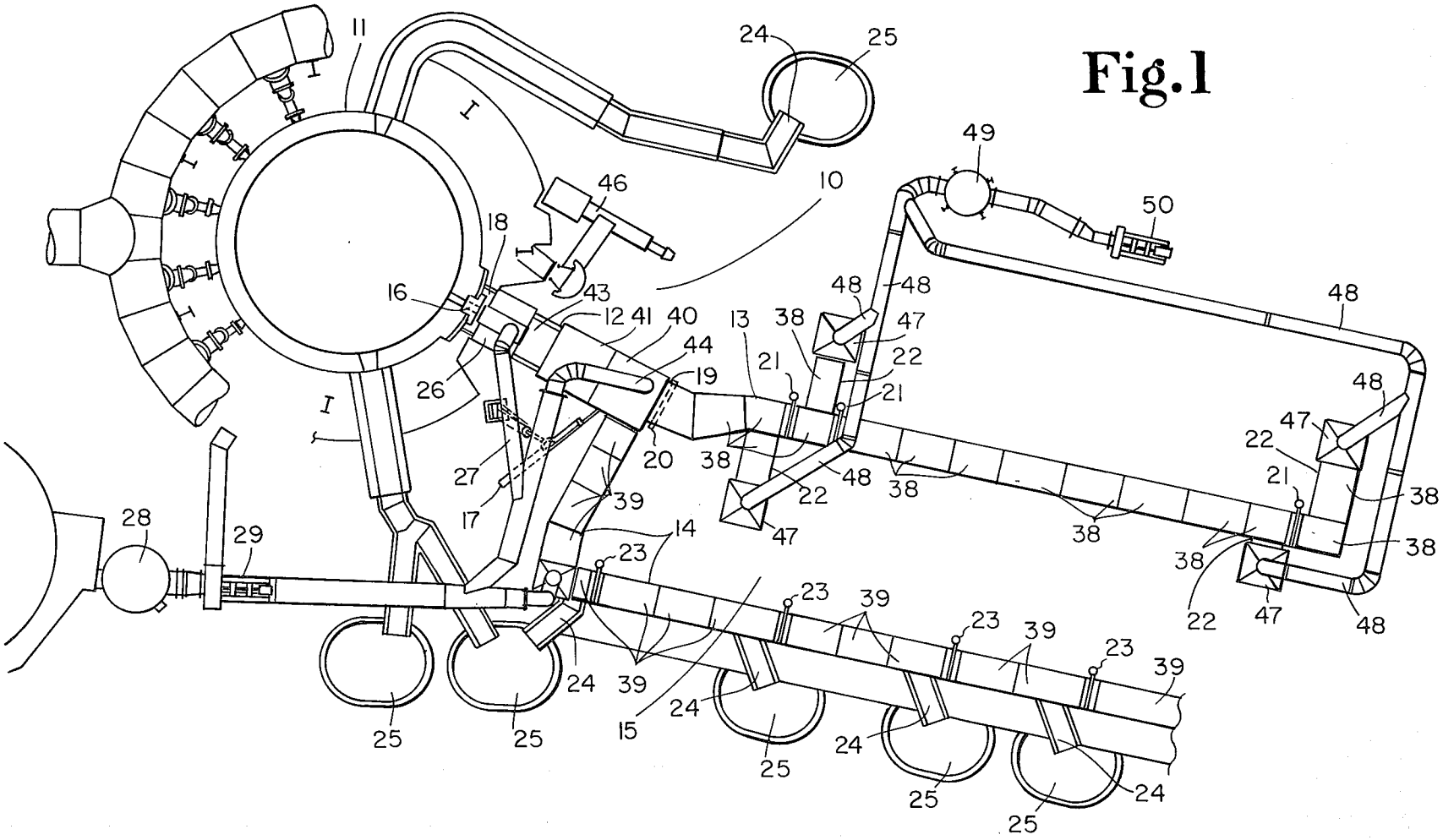
FIG. 1 is a system plan arrangement of a preferred embodiment of the casthouse emission control system of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1 there is shown a casthouse emission control system 10 for controlling the emissions released from the pig iron and slag released from the blast furnace 11 and flowing through the main iron trough 12, the iron runner 13 and the slag runner 14 in a casthouse 15.

The blast furnace 11 has a tap hole 16 as is known in the iron making art. When the iron in the blast furnace is of a sufficient quantity to be tapped for a cast the tap hole is pierced by a drill 17. The molten iron and slag then issues forth into the main iron trough 12. This trough 12 is usually about 5 feet wide by three feet deep and is made of carbon material. It is about 30 feet in length. At its first end 18 it is in flow communication with the tap hole of the furnace. Adjacent its second end 19 there is disposed a skimmer wall 20. As is known in the art a skimmer wall skims off the lighter slag from the iron and diverts it. Thus the iron and slag is separated.

When the molten iron and slag is tapped from the furnace 11 it is very hot, from about 2600 to 2800 degrees Farenheit. The molten mixture releases a great deal of smoke and heat. This smoke contains pollutants such as silicon oxide, graphite, iron oxides, particulates, heat and other pollutants. These pollutants are harmful to the environment and their emission is regulated by the Environmental Protection Agency.

After the molten iron and slag are separated by the skimmer 20 the molten iron flows into the iron runner 13 which is a trough shape and is made of carbon material. The molten slag is diverted by the skimmer 20 into the slag runner 14 which is also a trough made of carbon material. The flow of the molten material through the runners is because the troughs are inclined.

The iron runner 13 channels the molten iron to a plurality of iron exits. Throughout the iron runner there are gates 21. These gates shut off the main iron runner so that the iron will flow into the various iron exits 22. The iron then flows into the iron exit and through a hole in the cast house floor and into pugh ladles. A single pugh ladle holds, typically, 250 tons of iron. These pugh ladles are then transferred to basic oxygen furnaces where the iron becomes steel.

The slag flows through the slag runner 14. The slag runner 14 also has gates 23 and a plurality of slag exits 24. When a particular gate 23 is closed the slag flows into the slag ladle 25 where the slag is collected and then taken to a slag pile.

Throughout the flow of the iron and slag through their respective runners the molten material continues to release the pollutants previously mentioned. Therefore it is necessary to control these emissions throughout the system. For this purpose cover means are provided so as to cover the various troughs and substantially prevent the release of emissions into the ambient air.

Tap hole cover means 26 is provided and is disposed adjacent the first end 18 of the main trough. The tap hole cover means prevents the release of emissions into the ambient air by covering that portion of the trough. The tap hole cover means 26 also have a stack and pipe 27 through which by suction the emission is pulled. This pipe 27 is in flow communication with a scrubber 28. A Robinson fan 29 pulls the emissions through the pipe. The scrubber operates at about 300,000 Cubic feet per minute. As are all the covers this cover 26 has a steel outer shell 30 with a refractory carbon inner coating 31.

Figure 4:
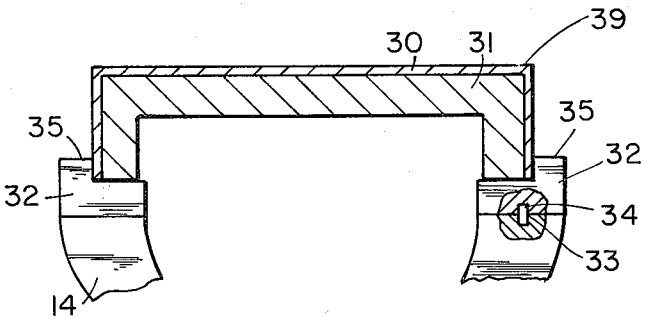
FIG. 4 is a front view in cross section of a slag runner cover.
Figure 8:
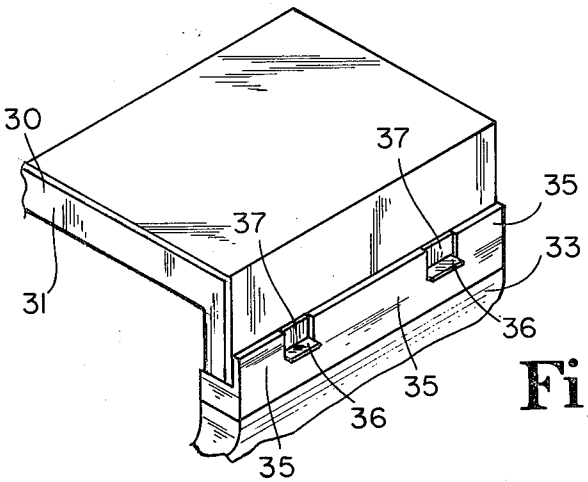
FIG. 8 is a perspective partial view of a slag runner cover and alignment clip assembly.

As are all the covers the covers are mounted to the troughs as is shown in FIGS. 4 and 8. There are two seating members 32 which rest on the troughs 33 and are held there by spikes 34. These seating members have projections 35 which surround the covers. The members 32 have notches 36 within which an angle iron 37 is received. The angle iron 37 is welded to the side of the cover. In this manner the covers can be properly aligned so that a good tight seal will result. There is a need for a plurality of covers because of the varying lengths of the troughs between successive gates.

Figure 7:
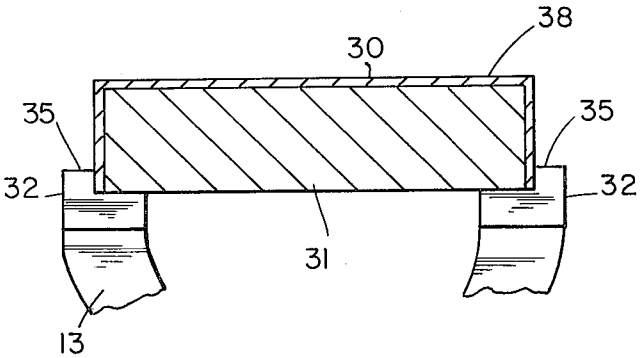
FIG. 7 is a front view of a iron runner cover.
Figure 6:
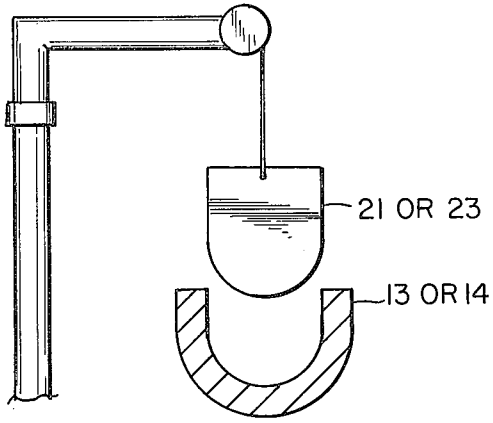
FIG. 6 is a front view of a gate arm and gate.

As shown in FIG. 7 the iron runner covers 38 are flat and as shown in FIG. 4 the slag runner covers 39 have a squared C-shape. Not all covers have been numbered as many are of similar design.

Figure 3:
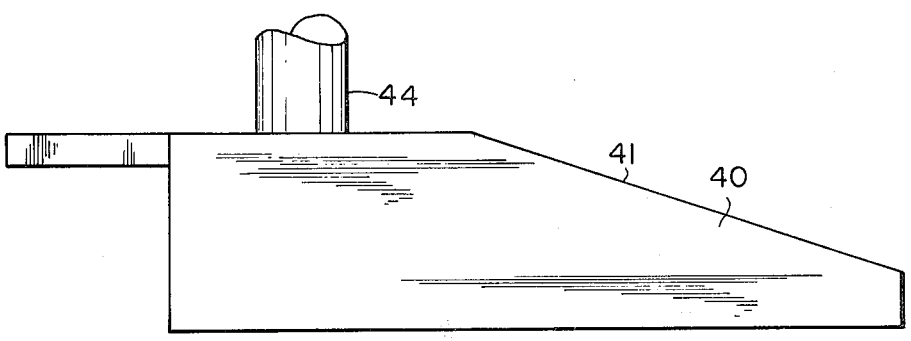
FIG. 3 is a side view of the removable cover.
Figure 5:
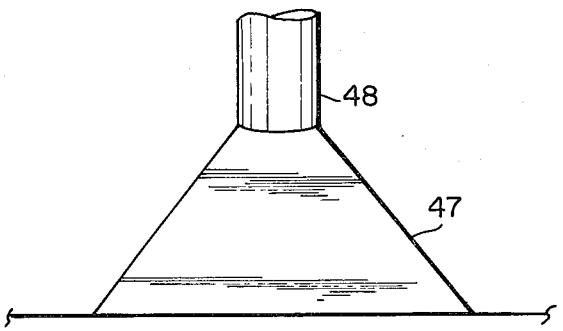
FIG. 5 is side view of a pugh ladle hood.
Figure 2:
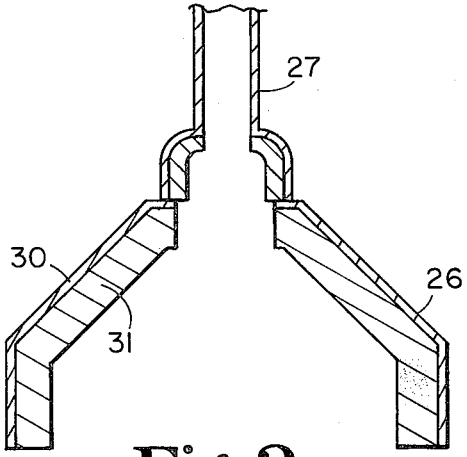
FIG. 2 is a side view in cross section of the tap hole cover.

There is provided at the second end of the main iron trough 12 a removable cover means 40 a side view of which is shown in FIG. 3. This removable cover means is mounted as are the others. However this cover has an inclined portion 41. The reason for this is that the tap drill 17 enters the tap hole under the cover 26 so as to pierce the tap hole plug as is known in the art this is done at about 22 degrees from the horizontal. This incline on the cover allows the drill to clear. Further the uncovered portion 43 gives clearance for the drill and allows an actual view of the cast so as to determine quality of the run. The removable cover 40 has a pipe 44 through which the emissions are evacuated as are done for the tap hole cover. There is provided a monorail system above the structure with a hoist so that the cover 40 can be removed so that mud gun 46 can plug the tap hole.

Finally there is provided hoods 47 over the hole in the casthouse floor through which the iron is poured into the ladles. These hoods 47 suck the emissions through pipes 48 by action of fan 50. The emissions are delivered to scrubber 49 and as is known in the scrubber art the air is cleaned. This scrubber and fan operate at about 10,000 cubic feet per minute.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

We claim:

1. A casthouse emission control system for controlling the emissions released from the pig iron and slag released from the blast furnace and flowing through the main iron trough, the iron runner and the slag runner in a casthouse, said system comprising:

a blast furnace having a tap hole;

a main iron trough having a first end and a second end, said first end of said main iron trough in flow communication with said tap hole;

a main iron runner having a first end and an iron exit end, said first end of the main iron runner in flow communication with said second end of the main iron trough;

a slag runner having a first end, said first end of the slag runner in flow communication with said second end of the main iron trough;

tap hole cover means for covering said first end of the main iron trough and for evacuating emissions released by said pig iron and slag flowing through said first end of the main iron trough, said tap hole cover means being in flow communication through first ducting with first scrubber means for receiving the emissions evacuated by said tap hole cover means and for cleaning said emissions;

removable cover means for covering said second end of the main iron trough and for evacuating emissions released by said pig iron and slag flowing through said second end of the main iron trough, said removable cover means being in flow communication through said first ducting with said first scrubber means for receiving the emissions evacuated by said removable cover means and for cleaning said emissions;

main iron runner cover means for covering the main iron runner to substantially prevent the escape of emissions into the ambient air;

slag runner cover means for covering the slag runner to substantially prevent the escape of emissions into the ambient air; and iron runner emission evacuation means disposed adjacent said iron exit end of the iron runner for evacuating emissions released by said pig iron and slag flowing through said iron exit end, said iron runner emission evacuation means being in flow communication through second ducting with second scrubber means for receiving the emissions evacuated by said removable cover means and for cleaning said emissions.

2. The casthouse emission control system of claim 1 wherein said tap hole cover means includes a first enlarged opening opposite said tap hole and an enclosed passageway defined by said tap hole cover means above said iron trough, and a second enlarged opening adjacent said tap hole and said enclosed passageway being in communication between said first enlarged opening and second enlarged opening; and said removable cover means having an inclined roof portion being inclined downwardly towards said first end of the iron trough.

3. A casthouse emission control system for controlling the emissions released from the pig iron and slag released from the blast furnace and flowing through the main iron trough, the iron runner and the slag runner in a casthouse, said system comprising:

a blast furnace having a tap hole;

a main iron trough having a first end and a second end, said first end of said main iron trough in flow communication with said tap hole;

a main runner having a first end and an iron exit end, said first end of the main iron runner in flow communication with said second end of the main iron trough;

tap hole cover means for covering a portion of said first end of the main iron trough adjacent said tap hole and for evacuating emissions released by said pig iron and slag flowing through said first end of the main iron trough, said tap hole cover means being in flow communication with scrubber means for receiving the emissions evacuated by said tap hole cover means and for cleaning said emissions;

said tap hole cover means includes a first enlarged opening opposite said tap hole and an enclosed passageway defined by said tap hole cover means above said iron trough, and a second enlarged opening adjacent said tap hole and said enclosed passageway being in communication between said first enlarged opening and second enlarged opening;

removable cover means for covering said second end of the main iron trough and for evacuating emissions released by said pig iron and slag flowing through said second end of the main iron trough, said removable cover means being in flow communication with said scrubber means for receiving the emissions evacuated by said removable cover means and for cleaning said emissions;

said removable cover means having an inclined roof portion being inclined downwardly towards said first end of the iron trough; and iron runner emission evacuation means disposed adjacent said iron exit end of the iron runner for evacuating emissions released by said pig iron and slag flowing through said iron exit end, said iron runner emission evacuation means being in flow communication with said scrubber means for receiving the emissions evacuated by said removable cover means and for cleaning said emissions.

4. The casthouse emission control system of claim 3 further comprising a slag runner having a first end, said first end of the slag runner in flow communication with said second end of the main iron trough;

main iron runner cover means for covering the main iron runner to substantially prevent the escape of emissions into the ambient air; and slag runner cover means for covering the slag runner to substantially prevent the escape of emissions into the ambient air.

5. The casthouse emission control system of claim 4 wherein said tap hole cover means being in flow communication through first ducting with first scrubber means for receiving the emissions evacuated by said tap hole cover means and for cleaning said emissions;

said removable cover means being in flow communication through first ducting with said first scrubber means for receiving the emissions evacuated by said removable cover means and for cleaning said emissions; and said iron runner emission evacuation means being in flow communication through second ducting with second scrubber means for receiving the emissions evacuated by said removable cover means and for cleaning said emissions.

6. The casthouse emission control system of claim 4 wherein said tap hole cover means includes tap hole cover seating alignment means for aligning and seating said tap hole cover means on a portion of said first end of the main iron trough adjacent said tap hole;

said removable cover means includes removable cover seating alignment means for aligning and seating said removable cover means on said second end of the main iron trough;

said main iron runner cover means includes iron runner cover seating alignment means for aligning and seating said main iron runner cover means on said main iron runner; and said slag runner cover means includes slag runner cover seating alignment means for aligning and seating said slag runner cover means on said slag runner.

7. The casthouse emission control system of claim 6 wherein said tap hole cover means includes a tap hole cover having first and second opposite upraised side walls and a generally arched roof member disposed atop and spanning between said first and second upraised side walls, said roof member having an emissions opening connected to said first ducting;

said tap hole cover seating alignment means includes a first cover seating block secured to the first edge of the first end of the main iron trough and a second cover seating block secured to the second opposite edge of the first end of the main iron trough, said first and second cover seating blocks having a plurality of alignment notches, and said first and second upraised side walls being received on said first and second cover seating blocks respectively, and said first and second upraised side walls having a plurality of seating protrusions received in said plurality of alignment notches;

said removable cover means includes a removable cover having removable cover first and second opposite upraised side walls and a removable cover roof member having a first section and a second inclined section, said removable cover roof member being disposed atop and spanning between said removable cover first and second upraised side walls, said first section having a removable cover emissions opening connected to said first ducting;

said removable cover seating alignment means includes a removable cover first cover seating block secured to the first edge of the second end of the main iron trough and a removable cover second cover seating block secured to the second opposite edge of the second end of the main iron trough, said removable cover first and second cover seating blocks having a plurality of removable cover alignment notches, and said removable cover first and second upraised side walls being received on said removable cover first and second cover seating blocks respectively, and said removable cover first and second upraised side walls having a plurality of seating protrusions received in said plurality of removable cover alignment notches;

said iron exit having a hole in said casthouse floor beneath which is disposed a pugh ladle and said iron runner emission evacuation means includes a generally frusto-conical hood disposed adjacent and above said iron exit, said hood having a hood emissions opening connected to said second ducting.

8. The casthouse emission control system of claim 7 wherein said main iron runner cover means includes a plurality of slab iron runner covers and said iron runner cover seating alignment means includes a plurality of iron runner cover seating blocks secured to the first edge and opposite second edges of the main iron runner, said plurality of iron runner cover seating blocks having a plurality of iron runner cover alignment notches, and said plurality of slab iron runner covers being received on said plurality of iron runner cover seating blocks respectively, and said plurality of slab iron runner covers having a plurality of seating protrusions received in said plurality of iron runner cover alignment notches; and said slag runner cover means includes a plurality of generally C-shaped slab runner covers and said slag runner cover seating alignment means includes a plurality of slag runner cover seating blocks secured to the first edge and opposite second edges of the slag runner, said plurality of slag runner cover seating blocks having a plurality of slag runner cover alignment notches, and said plurality of generally C-shaped slag runner covers being received on said plurality of slag runner cover seating blocks respectively, and said plurality of generally C-shaped slag runner covers having a plurality of seating protrusions received in said plurality of slag runner cover alignment notches.

* * * * *